United States Patent [19]

Lofland

[11] Patent Number: 4,589,220

[45] Date of Patent: May 20, 1986

[54] DEVICE FOR AIDING IN LOADING OF MUZZLE LOADING FIREARMS OF THE FLINTLOCK TYPE

[76] Inventor: James W. Lofland, 2275 Larkin Rd., Boothwyn, Pa. 19061

[21] Appl. No.: 759,672

[22] Filed: Jul. 29, 1985

[51] Int. Cl.[4] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 3,775,889 | 12/1973 | Wilburn | 42/90 |
| 4,112,606 | 9/1978 | Griffin | 42/90 |
| 4,229,897 | 10/1980 | Snowden | 42/90 |
| 4,369,594 | 1/1983 | Zurga | 42/90 |
| 4,384,424 | 5/1983 | Fowler | 42/90 |
| 4,442,620 | 4/1984 | Drake et al. | 42/90 |
| 4,466,209 | 8/1984 | Strickland et al. | 42/90 |
| 4,550,517 | 11/1985 | Mansfield | 42/90 |

*Primary Examiner*—Charles T. Jordan

*Attorney, Agent, or Firm*—Robert S. Lipton; Robert B. Famiglio; Barbara C. Siegell

[57] ABSTRACT

This invention is a pocket sized, block shaped device for storing the powder, projectiles and trouble shooting tools necessary for the rapid loading of the flintlock type, muzzle loading firearms, when used in the field. The device permits the user to premeasure a plurality of gunpowder charges into cavities bored into the body of the device, for later successive release by means of a novel sliding release mechanism. A dispenser for priming powder is frictionally housed within the body of the device for easy access and use. In addition, the user can insert a plurality of patched projectiles into sleeves bored into the device for successive release, later, when needed in the field. The device also houses an array of tools needed for maintenance of the gun and trouble shooting under field conditions.

13 Claims, 4 Drawing Figures

DEVICE FOR AIDING IN LOADING OF MUZZLE LOADING FIREARMS OF THE FLINTLOCK TYPE

BACKGROUND OF THE INVENTION

1. Field of the Invention

The present invention pertains to the loading of muzzle-loading firearms of the flintlock type. More particularly, the invention relates to a device for carrying all the necessary supplies for quickly reloading such a firearm and for various trouble shooting procedures as would be required for a typical single day's use of the firearm in the field.

Traditionally, the user of a muzzle loaded firearm carried his gun powder in a powder horn while the projectiles, patches and other ingredients or implements needed to load the gun were retained, loose, in another receptacle. The reloading of the firearms under field use conditions was time consuming as the user had to measure the amount of gun powder and ingredients and prepare his projectiles for insertion into the gun. The ability to fire a second shot quickly has been of particular importance to game hunters who would, occasionally, wound, rather than kill, an animal only to see the wounded animal run away before the firearm could be reloaded for a second attempt at a successful hunt. Accordingly, various inventors have tried to assist the user of these guns by devising ways to store premeasured charges of gun powder, ways to carry the projectiles and ways to load the gun quickly. Typically, these prior inventions have either accomodated only one premeasured charge of gun powder or have lacked all the benefits exhibited by the present combination.

Accordingly, the present invention provides a device to promote rapid reloading of a muzzle loading firearm by releasing, via a novel dispensing mechanism, successive, premeasured portions of gun powder and also releasing priming powder using a novel mechanism. The invention also has a plurality of individual compartments for storing patch wrapped projectiles so that they are ready for immediate insertion into the firearm. In addition, the device has, conveniently located within its body, a number of implements needed for handling problems experienced with the firearm when it is used in the field.

2. Description of the Prior Act

A number of prior patents have been issued for devices pertaining to the carrying of ingredients and equipment for the rapid loading and the maintenance of muzzle loading guns. U.S. Pat. No. 4,112,606, by Griffin, U.S. Pat. No. 4,229,897 by Snowden, and U.S. Pat. No. 4,466,209 by Strickland et al teach devices that hold premeasured quantities of gun powder and projectiles but only allow the preparation of a single charge. U.S. Pat. No. 4,384,424 describes a block shaped device for storing and lubricating conical shaped balls. U.S. Pat. No. 3,775,889 by Wilburn, an improvement on the traditional "powder horn", has a receptacle for caps and balls in the plug of the powder horn.

U.S. Pat. No. 4,442,620, by Drake et al, houses the powder and projectiles necessary for loading the gun and a ball starter, but lacks a housing for the priming powder and the trouble shooting tools often necessary when the gun is used.

The above inventions are either strictly one shot devices or conspicuously lack a means to store some or all of the ingredients or equipment for using flintlock firearms found in the present invention. In addition, none of the inventions discovered by our search have the unique sliding mechanism and attached funneling system, found in the present invention, for successive discharge of the powder charges into the muzzle of the rifle. Also, none of the patents disclose a recepticle that frictionally engages the body of the storage device, for storing priming powder.

SUMMARY OF THE INVENTION

The primary object of the present invention is to provide a novel container for keeping the items that a muzzle loading gun user needs for rapid loading of his gun under field conditions.

Another object of the invention is to permit the storage of a plurality of premeasured portions of gun powder, and separately store a plurality of projectiles appropriate to the caliber of the user's rifle, for rapid loading of the gun when needed.

Another object of the invention is to provide the ingredients and equipment for a muzzle loading gun in a kit form that can fit into a user's trousers or shirt pocket.

Still another object of the invention is to provide a muzzle loading device that can be constructed for use with muzzle loaded rifles of various calibers.

Yet another object of the invention is to provide a sleeve, perforated on both sides, for frictionally holding pre-patched projectiles; so that a ram rod or other projectile releasing tool can quickly transfer the projectile to the muzzle of the firearm.

An additional object of the present invention is to accessibly provide to the user of the muzzle loading gun, such trouble shooting implements as, for example, means for removing undesirably lodged balls or patches remaining in the gun.

These objects are achieved by the present invention which is a pocket sized, block shaped device for carrying the gun powder, priming powder, patched balls and trouble shooting implements necessary for a day's use of a muzzle loaded firearm. The invention facilitates the loading of the gun powder into the firearm's muzzle by retaining the gun powder in premeasured quantities in a plurality of cavities bored into the sides of the block. A novel, slidably mounted covering means, with a funneling means for covering the powder filled cavities, permits successive discharge of each charge of gun powder through the funnel means, when it is positioned in the muzzle of the firearm. The necessary priming powder is then released into the pan of the flintlock rifle from a container, such as a bottle, that is frictionally engaged by the body of the device and that can be manually pressed forward and tapped into the pan for release of priming powder. A plurality of previously prepared and treated patch wrapped projectiles, inserted into sleeves bored through the block, are easily released into the muzzle of the firearm by the use of, first, a short starter, then by use of a ram rod. The short starter and ram rod are standard equipment with muzzle loading guns. Various trouble shooting tools for use in cleaning out the barrel and in performing such operations as retrieving the patch or for removing a musket ball undesirably lodged in the barrel of the rifle are retained in holes bored in the block and are released for use by unscrewing covering knobs located at various places on the block.

Other objects and advantages of the present invention will become more apparent from the following description of the preferred embodiment, taken in conjunction with the accompanying drawings.

DESCRIPTION OF THE PREFERRED EMBODIMENT

Figure 1:
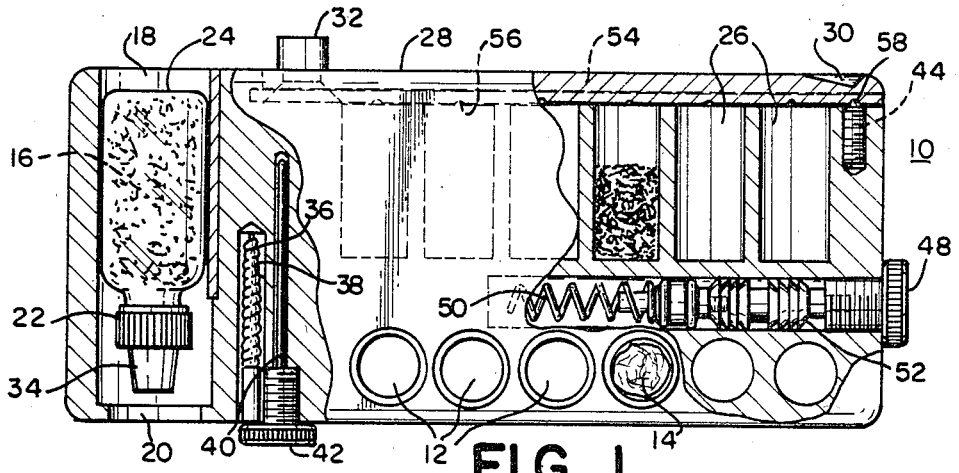
FIG. 1 is a top, cross sectional perspective of the main body of the loading block.

Like characters of reference designate like parts in those figures of the drawing in which they occur.

In FIG. 1, the reference numeral 10 indicates the loading device as a whole which is a block shaped device, approximately 7 inches by 3 inches by 1 inch, in size and formed of some solid material such as wood or plastic (but not limited to these materials), with holes 12 bored vertically through the block. When in use, these holes house patched balls 14. Priming powder is kept in container 16 that is frictionally engaged in the main body of the device, having entered through opening 18. Opening 18 is at one end of bore 22 that extends to opening 20. Opening 20 is structured so that it permits only the cover region of the container to project from container 16 when the bottom of the container 24 is pressed, for example, by a finger, at open end 18.

Bullet puller 36 is shown inserted in a hole 38 bored through the side of block 10. Flash hole cleaner pick 40 is screwed into knurled knob 42 which also covers the hole where bullet puller 36 is retained. Second knurled knob 48, is shown, screwably connected to patch-puller 50 and ram rod jag 52, which can be detached and connected to a ram rod (not shown) for use.

Figure 2:
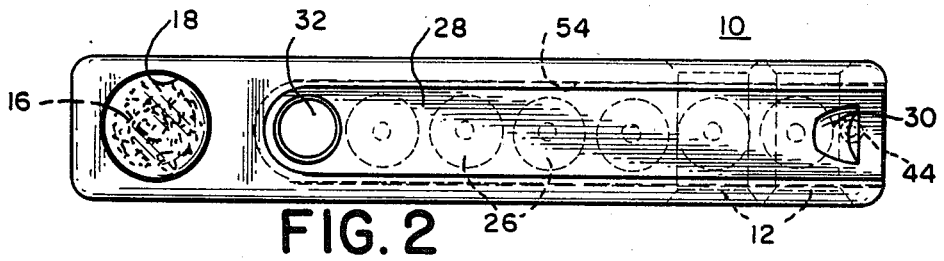
FIG. 2 is a side view of the loading block showing the exclusive slide mechanism for powder release.

FIG. 2 shows a side view of block 10. A plurality of cylindical shaped cavities 26, bored into the side of the block and each one large enough to retain a measured quantity of gun powder so as to constitute one charge, are covered by sliding means 28. Sliding means 28 fits into recessed area 54 and is moved by finger motion at finger groove 30. Funnel means 32, open on both ends, is molded on sliding means 28, at the opposite end from finger groove 30. When it is desired to release a charge of gun powder, sliding means 28 is moved so that funnel means 32 covers a powder cavity 26. Block 10 is then inverted so that funnel means 32 inserts into the muzzle of the gun and permits transfer of the powder into the gun without spillage. The underside of sliding means 28, shown in side view in FIG. 1, has indentations 56 that hook onto the tip 58 of Vlier Ball Plunger 44, when the sliding means is moved so that it successively exposes the cavities containing gun powder and so that funnel means 32 is centered over the powder cavity.

Figure 3:
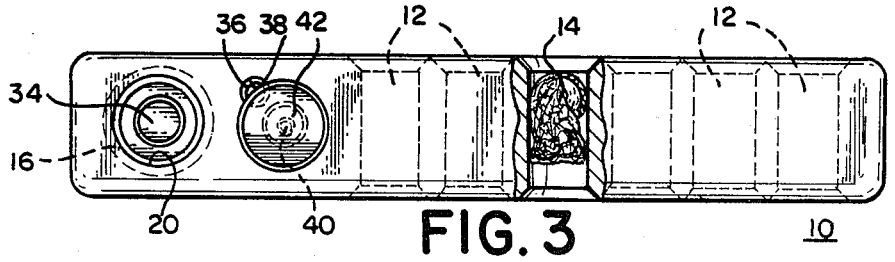
FIG. 3 is a second side view of the invention.

FIG. 3 shows a second side view of block 10, and shows lid 34 of bottle 16 on one side next to a top view of knurled knob 42, partially covering bullet puller 36. Also shown is a cross section of one of the holes 12 with a patched ball 14.

Figure 4:
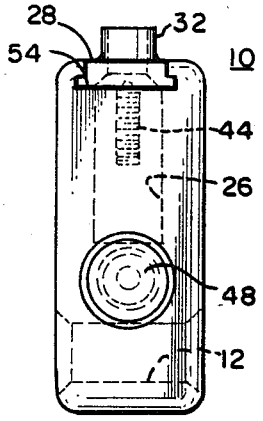
FIG. 4 is an end view of the invention.

FIG. 4 shows an end view of block 10 showing an additional view of Vlier Ball Plunger 44 and a top view of knurled knob 48. Cross sectional views of a hole 12, a powder cavity 26 and funnel means 32 are shown. Sliding means 28 slides out perpendicular to the end of the block shown in FIG. 4, along recessed area 54.

In that the present invention is subject to many variations, modifications and changes in detail, it is intended that all subject matter discussed in the specifications and shown in the drawings be interpreted as illustrative and not as limiting this invention.

What is claimed is:

1. A self contained loading device and implement housing device, for use with flintlock type muzzle loading firearms comprising:

an elongated block, made of solid material, having a top face, a bottom face and a verticle dimension;

a plurality of sleeves bored through said block, each of said sleeves having a diameter consistent with that of the caliber of a gun muzzle so as to be loaded and able to house a patched projectile sized for said caliber;

a plurality of cavities bored into one side of each block, each of such cavities of sufficient size to hold one premeasured charge of gun powder;

a means for covering said side cavities and for successively transferring said measured charges of gun powder, without ingredient loss, into a muzzle of a firearm;

a container, frictionally engaged in the body of the device, for holding and dispensing priming powder;

a plurality of holes drilled into the block, at various locations, for containing such devices or implements, but not limited to, a bullet puller, flash hole cleaner pick, patch puller, a ram rod jag, and a Vlier Ball Plunger;

retention means for keeping said bullet puller, flash hole cleaner pick, patch puller, and ram rod jag or other like implements, from falling out from the block when not in use.

2. A self contained loading device and implement housing device, for use with flintlock type muzzle loading firearms, as described in claim 1, wherein said means for covering said side cavities containing gun powder is an oblong sliding means, connected to said side surface, so that movement of the sliding means successively exposes cavities containing gun powder.

3. A self contained loading device, and implement housing device, for use with flintlock type muzzle loading firearms, as described in claim 2, wherein the oblong sliding means is situated in a recessed area adapted to fit the dimension of the sliding means, so that the sliding means remains flush with the surface of the block.

4. A self contained loading device and implement housing device for use with flintlock type muzzle loading firearms, as described in claim 3, wherein said oblong sliding means has a funnel means molded on one end for insertion into a gun's muzzle to transfer a charge of gun powder into the muzzle.

5. A self contained loading device and implement housing device, for use with flintlock type muzzle loading firearms, as described in claim 4, wherein said sliding means has, on its underside, a series of depressions separated by non depressed area, for hooking onto a stopping means for centering said funnel means over the successively exposed powder cavities.

6. A self contained loading device and implement housing device, for use with flintlock type muzzle loading firearms, as described in claim 5, wherein said stopping means is a Vlier Ball Plunger that protrudes from a hole drilled into the same side upon which the sliding means is located.

7. A self contained loading device and implement housing device for use with flintlock type muzzle loading firearms, as described in claim 4, wherein the sliding means has a finger groove on the opposite end from the funnel means.

8. A self contained loading device and implement housing device, for use with flintlock type muzzle loading firearms, as described in claim 1, wherein said retention means for preventing the various tools from falling out from the block is a knurled knob attached to a suitable implement and adapted to be screwed into a cavity in the block.

9. A self contained loading device and implement housing device, for use with flintlock type muzzle loading firearms, as described in claim 1, wherein said solid material for the block is plastic.

10. A self contained loading device and implement housing device, for use with flintlock type muzzle loading firearms, as described in claim 1, wherein said solid material for the block is wood.

11. A self contained loading dvice and implement housing device, for use with flintlock type muzzle loading firearms, as described in claim 1, wherein said solid material for the block is metal.

12. A self contained loading device and implement housing device, for use with flintlock type muzzle loading firearms, as described in claim 1, wherein said container means for retaining and dispensing priming powder. frictionally engaged in the body of the device, is a bottle.

13. A self contained loading device and implement housing device, for use with flintlock type muzzle loading firearms, as described in claim 12, wherein said bottle for retaining and dispensing priming powder is made of plastic.

* * * * *